US008656999B2

(12) United States Patent
Latimer et al.

(10) Patent No.: US 8,656,999 B2
(45) Date of Patent: Feb. 25, 2014

(54) WATER TREATMENT USING A DIRECT STEAM GENERATOR

(75) Inventors: Edward G. Latimer, Ponca City, OK (US); James P. Seaba, Bartlesville, OK (US); Thomas J. Wheeler, Houston, TX (US); David C. LaMont, Calgary (CA)

(73) Assignee: ConocoPhillips Company, Houston, TX (US)

( * ) Notice: Subject to any disclaimer, the term of this patent is extended or adjusted under 35 U.S.C. 154(b) by 377 days.

(21) Appl. No.: 13/091,737

(22) Filed: Apr. 21, 2011

(65) Prior Publication Data

US 2011/0259586 A1 Oct. 27, 2011

Related U.S. Application Data

(60) Provisional application No. 61/327,349, filed on Apr. 23, 2010.

(51) Int. Cl.
*E21B 43/24* (2006.01)

(52) U.S. Cl.
USPC ..... 166/272.3; 166/57; 166/302

(58) Field of Classification Search
None
See application file for complete search history.

(56) References Cited

U.S. PATENT DOCUMENTS 3,285,832 A 11/1966 Sephton
4,251,236 A 2/1981 Fattinger et al.
4,558,743 A * 12/1985 Ryan et al. ..... 166/303
4,580,504 A * 4/1986 Beardmore et al. ..... 110/261
4,604,988 A 8/1986 Rao
5,358,357 A 10/1994 Mancini
6,206,684 B1 3/2001 Mueggenburg
6,299,735 B1 10/2001 Lumbreras
6,536,523 B1 3/2003 Kresnyak et al.
2003/0127226 A1 * 7/2003 Heins ..... 166/303
2006/0024135 A1 * 2/2006 Reinhardt et al. ..... 405/128.85
2007/0012556 A1 * 1/2007 Lum et al. ..... 203/10
2007/0045100 A1 * 3/2007 Wright ..... 203/49
2007/0202452 A1 8/2007 Rao
2007/0245736 A1 * 10/2007 Barnicki ..... 60/670
2007/0283905 A1 * 12/2007 Reinhardt ..... 122/348
2008/0110630 A1 * 5/2008 Minnich et al. ..... 166/303
2008/0289821 A1 * 11/2008 Betzer Tsilevich ..... 166/272.3
2008/0289822 A1 * 11/2008 Betzer Tsilevich ..... 166/272.3
2009/0211539 A1 * 8/2009 Tsilevich ..... 122/11
2010/0147516 A1 * 6/2010 Betzer-Zilevitch ..... 166/272.6
2010/0170453 A1 * 7/2010 Betzer-Zilevitch ..... 122/6 R

OTHER PUBLICATIONS

PCT Notification of Transmittal of the International Search Report and the Written Opinion of the International Searching Authority, or the Declaration, Application No. PCT/US2011/033453, Jul. 7, 2011, 11 pages.

* cited by examiner

*Primary Examiner* — Angela M DiTrani
*Assistant Examiner* — Anuradha Ahuja
(74) *Attorney, Agent, or Firm* — ConocoPhillips Company

(57) ABSTRACT

The present method produces treated water from a direct steam generator. The method begins by injecting water into a direct steam generator. The injected water is then vaporized with the direct steam generator to produce steam and an effluent stream. The combustible water impurities in the water are then combusted inside a chamber in the direct steam generator and the solid particles are removed from the effluent stream to produce a treated stream.

9 Claims, 2 Drawing Sheets

WATER TREATMENT USING A DIRECT STEAM GENERATOR

CROSS-REFERENCE TO RELATED APPLICATIONS

This application is a non-provisional application which claims the benefit of and priority to U.S. Provisional Application Ser. No. 61/327,349 filed Apr. 23, 2010, entitled "Removing Particles from a Direct Steam Generator," which is hereby incorporated by reference in its entirety.

STATEMENT REGARDING FEDERALLY SPONSORED RESEARCH OR DEVELOPMENT

None

FIELD OF THE INVENTION

A method for removing contaminates from a direct steam generator.

BACKGROUND OF THE INVENTION

Conventional, oil recovery involves drilling a well and pumping a mixture of oil and water from the well. Oil is separated from the water and the water is usually injected into a sub-surface formation. Conventional recovery works well for low viscosity oil. However, conventional oil recovery processes do not work well for higher viscosity, or heavy, oil.

Enhanced oil recovery processes employ thermal methods to improve the recovery of heavy oils from sub-surface reservoirs. The injection of steam into heavy oil bearing formations is a widely practiced enhanced oil recovery method. Typically, several tonnes of steam are required for each tonne of oil recovered. Steam heats the oil in the reservoir, which reduces the viscosity of the oil and allows the oil to flow to a collection well. After the steam fully condenses and mixes with the oil the condensed steam is classified as produced water. The mixture of oil and produced water that flows to the collection well is pumped to the surface. Oil is separated from the water by conventional processes employed in conventional oil recovery operations.

For economic and environmental reasons it is desirable to recycle the water used in the steam injection. This is accomplished by treating the produced water and directing the treated feedwater to a steam generator or boiler.

Several treatment processes are used for converting produced water into steam generator or boiler feedwater. These processes typically remove constituents which form harmful deposits in the boiler or steam generator. These water treatment processes used in steam injection enhanced oil recovery typically do not remove all dissolved solids, such as sodium and chloride.

Water treatment is a necessary operation in heavy oil recovery operations. This is because in order to recover heavy oil from certain geologic formations, steam is required to increase the mobility of the oil in the formation. Traditionally, heavy oil recovery operations have utilized "once through" type steam generators. The steam is injected via injection wells to fluidize the heavy oil. Different percentages of water and steam can be injected into the injection wells. The decision to vary the percentages of water and steam to be injected into the injection well depend a variety of factors including the expected output of oil and the economics of injecting different water/steam mixtures. An oil/water mixture results, and the mixture is pumped to the surface. Then, the sought-after oil is separated from the water and recovered for sale.

The produced water stream, after separation from the oil, is further de-oiled, and is treated for reuse. Most commonly, the water is sent to the "once-through" steam generators for creation of more steam for oil recovery operations. The produced water stream is typically required to have less than about 8000 PPM TDS (as well as meeting other specific constituent requirements) for re-use. Thus, in most cases, the recovered water must be treated before it is sent to the steam generators. Normally, such treatment is initially accomplished by using a warm lime softener, which removes hardness, and which removes some silica. Then, an "after-filter" is often utilized, to prevent carry-over of any precipitate or other suspended solids. For polishing, in a hardness removal step, a weak acid cation (WAC) system is often utilized to simultaneously remove hardness and the alkalinity associated with the hardness.

A relatively new heavy oil recovery process, referred to as the Steam Assisted Gravity Drainage heavy oil recovery process (the "SAGD" process), ideally utilizes 100% quality steam for injection into wells (i.e., no liquid water). Initially, water utilized for generating steam in such operations can be treated much the same as in the just discussed traditional heavy oil recovery operations. However, in order to produce 100% quality steam using a once-through type steam generator, a series of vapor-liquid separators are required to separate the liquid water from the steam. The 100% quality steam is then sent down the well and injected into the desired formation.

Another method for generating the required 100% quality steam involves the use of packaged boilers. Various methods are well known for producing water of sufficient water to be utilized in a packaged boiler. One method which has been developed for use in heavy oil recovery operations involves de-oiling of the produced water, followed by a series of physical-chemical treatment steps. Such additional treatment steps normally include such unit operations as warm lime softening, after-filtration, organic traps, pre-coat filters or ultrafiltration, reverse osmosis, and mixed bed demineralization. Such a physical-chemical treatment system may have a high initial capital cost, and generally involves significant ongoing chemical costs. Moreover, there are many waste streams to discharge, involving a high sludge disposal cost. Further, where membrane systems such as ultrafiltration or reverse osmosis are utilized, relatively frequent membrane replacement is encountered, at significant additional cost. Also, such processes can be quite labor intensive to operate and to maintain. Therefore, it is clear that the development of a simpler, more cost effective approach to produced water treatment as necessary for packaged boiler make-up water would be desirable.

In summary, the currently known and utilized methods for treating heavy oil field produced waters in order to generate high quality steam for down-hole are not entirely satisfactory because: most physical chemical treatment systems are quite extensive, are relatively difficult to maintain, and require significant operator attention; they often require liquid-vapor separation equipment, which adds to equipment costs; a large quantity of unusable hot water is created, and the energy from such water must be recovered, as well as the water itself, in order to maintain an economic heat and material balance in plant operations; they require large amounts of expensive chemicals, many of which require special attention for safe handling, and which present safety hazards if mishandled; the treatment train produces fairly substantial quantities of undesirable sludges and other waste streams; the disposal of waste sludges and other waste streams is increasingly difficult, due to stringent environmental and regulatory requirements.

Thus, it can be appreciated that it would be advantageous to provide a new process which minimizes the production of undesirable waste streams, while minimizing the overall costs of owning and operating a heavy oil recovery plant by eliminating the water treatment system and conventional boilers with a single system.

SUMMARY OF THE INVENTION

The present method produces treated water from a direct steam generator. The method begins by injecting water into a direct steam generator. The injected water is then vaporized with the direct steam generator to produce steam and an effluent stream. The combustible water impurities in the water are then combusted inside a chamber in the direct steam generator and the solid particles are removed from the effluent stream to produce a treated stream.

In an alternate embodiment the present method also begins by injecting water into a direct steam generator. The injected water is then simultaneously vaporized with the direct steam generator to produce steam and an effluent stream while combusting the combustible water impurities in the injected water inside the direct steam generator. Additional water is then sprayed into the direct steam generator such that the effluent stream is oversaturated to produce a two-phase effluent stream comprising a gaseous phase and an aqueous phase that contains the water-soluble impurities in the effluent stream. The aqueous phase containing the water-soluble impurities are then separated from the effluent stream of the direct steam generator in a phase separation vessel to produce a treated stream.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

The present method produces treated water from a direct steam generator. The method begins by injecting water into a direct steam generator. The injected water is then vaporized with the direct steam generator to produce steam and an effluent stream. The combustible water impurities in the water are then combusted inside a chamber in the direct steam generator and the solid particles, suspended in the original water stream and formed from the dissolved water-soluble impurities, are removed from the effluent stream to produce a treated stream.

The direct steam generator is able to produce high quality steam with lower quality water since combustible water impurities in the water are combusted and the solid particles can be removed from the effluent. Therefore the direct steam generator when used in combination with heat-assisted heavy oil production can replace both the water treatment and steam generation systems resulting in substantial cost savings compared to conventional heavy oil facilities.

As known to those skilled in the art a variety of different direct steam generators can be utilized for this method. One example of a direct steam generator that can be utilized is an oxycombustion device that burns natural gas and oxygen in a pressurized chamber, with water injected into the system to cool the chamber as it vaporizes to steam. The products of a direct steam generator are primarily water, both from the combustion of natural gas and the vaporization of the injected cooling water, and $CO_2$ from the combustion of natural gas. Another type of direct steam generator that can be used is one that has an oxycombustion device that burns a hydrocarbon fuel with oxygen at pressurized conditions, with water injected into the device to cool the combustion chamber and the effluent gas. The injected water vaporizes to steam which adds significantly to the combustion water vapor created, and the total effluent stream is about 80-95 wt % steam with the balance being primarily carbonaceous combustion products such as carbon dioxide.

Figure 1:
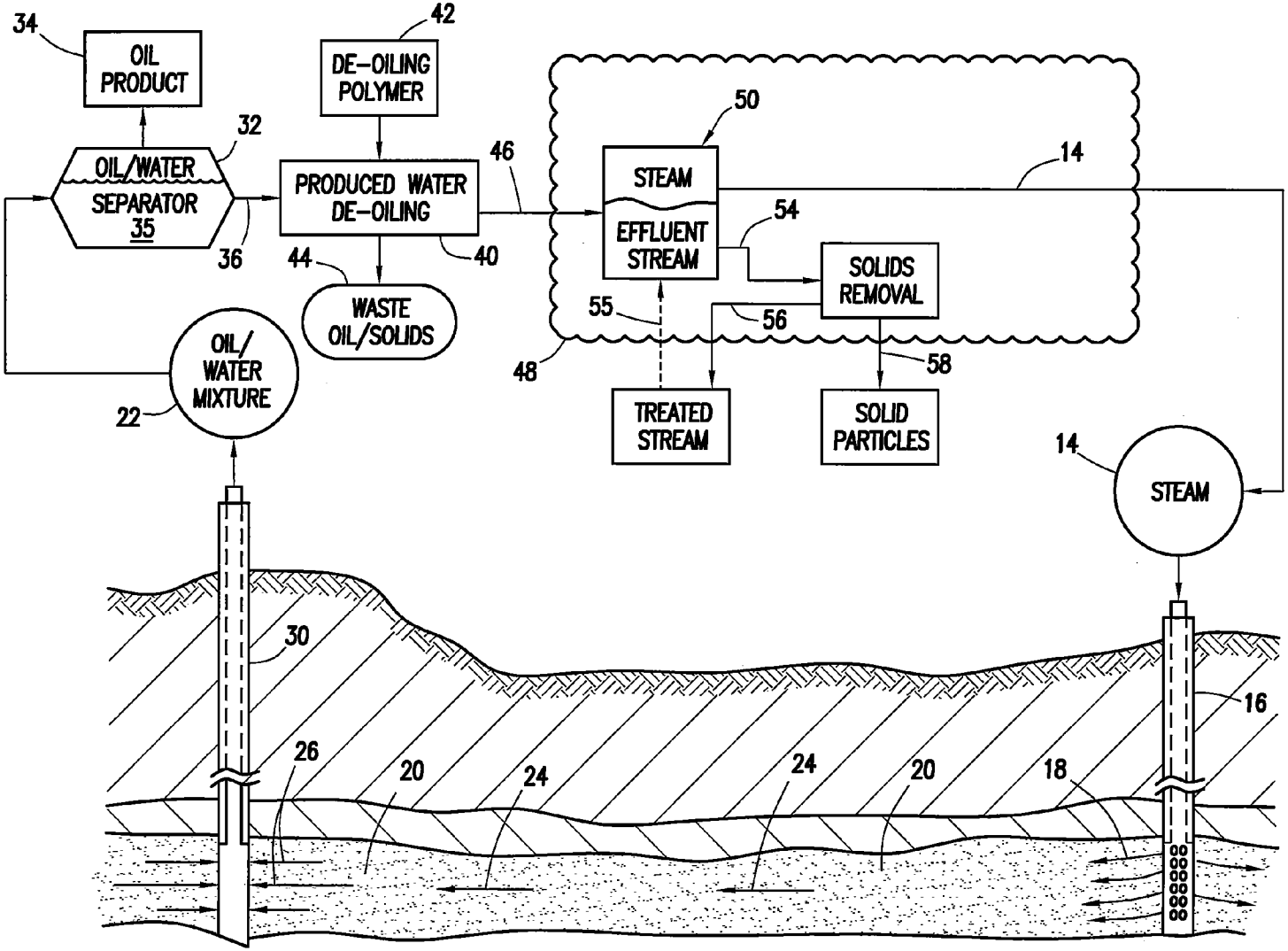
FIG. 1 depicts an application of the direct steam generator in a heavy oil extraction.

In one embodiment the direct steam generator is used during heavy oil extraction. During heavy oil extraction steam is required to increase the mobility of the sought after oil within the formation. FIG. 1 depicts an embodiment wherein the direct steam generator is used in conjunction with heavy oil extraction. In this figure high quality steam is injected downhole 14. The quality steam is at least 80% but can be as high as 100% steam. The steam is then injected downhole via steam injection wells 16 to fluidize as indicated by reference arrows 18, along or in combination with other injections, the heavy oil formation 20, such as oils in tar sands formations.

FIG. 1 only depicts the typical vertical design of the steam injection well 16 however different commonly known designs for the steam injection well can be used.

In this embodiment steam 14 eventually condenses and an oil/water mixture 22 results that migrates through the formation 20 as indicated by reference arrows 24. The oil/water mixture 22 is gathered as indicated by reference arrows 26 by oil/water gathering wells 30 and is pumped to the surface. Then, the sought-after oil is sent to an oil/water separator 32 in which the oil product 34 separated from the water 35 and recovered for sale. The produced water stream 36, after separation from the oil, can be further de-oiled in a de-oiling process step 40, normally by addition of a de-oiling polymer 42, which de-oiling process usually results in waste oil/solids sludge 44. The de-oiled produced water stream 46 would then be further treated for reuse.

The direct steam generator 48 can receive the de-oiled produced water stream 46, either with or without the de-oiling step, and external water 50. In an alternate embodiment the water stream can be produced from the reservoir, or external water, or water from another stream in the SAGD facility. The external water can be either salt water or desalted water. When the water is injected into the direct steam generator it is vaporized to produce steam 14 and an effluent stream 54. Inside the direct steam generator 48 the combustible water impurities are combusted inside a chamber and the solid particles 58 are removed from the effluent stream to produce a treated stream 56. This treated stream 56 can be optionally used (as depicted by dashed line 55) in the direct steam generator 48 to produce steam 14.

The combustible water impurities that can be combusted inside the direct steam generator include all typical types of combustible impurities typically found in heavy oil such as tar, gas, oil, dioxins, nitrogen and organometallic compounds.

In one embodiment the removal of the solid particles from the effluent stream are done by spraying additional water into the direct steam generator such that the effluent stream is oversaturated to produce a two-phase effluent stream comprising a gaseous phase and an aqueous phase that contains the water-soluble impurities in the effluent stream. A phase separation vessel is then used to remove the impurities in the aqueous phase to produce a treated stream.

A variety of different phase separation vessels can be used to remove the solid particles, one particular embodiment involves a cyclone or a cyclonic type device. The cyclone used can be any conventional known cyclone wherein use is made of the difference in specific gravity between the various parts forming the mixture. As the effluent stream enters the cyclone the swirling of the cyclone gradually imposes rotation to the multi-phase mixture. The heavier contaminates are flung from the cyclone as waste material while the lighter fluid flow out of the cyclone to become treated water.

In another embodiment the phase separation vessel can be a knock-out pot for removing the liquid from the two-phase effluent stream. The knock-out pot can have a demister pad to remove entrained liquid droplets from the two-phase effluent stream.

The contaminates that can be removed from the effluent stream includes but is not limited to NaCl, Ca, Mg, Na, K, $Fe^{+3}$, $Mn^{+2}$, $Ba^{+2}$, $Sr^{+2}$, $SO_4$, Cl, F, $NO_3$, $HCO_3$, $CO_3$, $PO_4$, $SiO_2$. A typical untreated concentration total for all the above contaminates is 1,000 to 10,000 mg/liter. The two dominant contaminates are typically Na+ and Cl−, which would form solid NaCl crystals after complete vaporization of all the water inside the direct steam generator.

Figure 2:
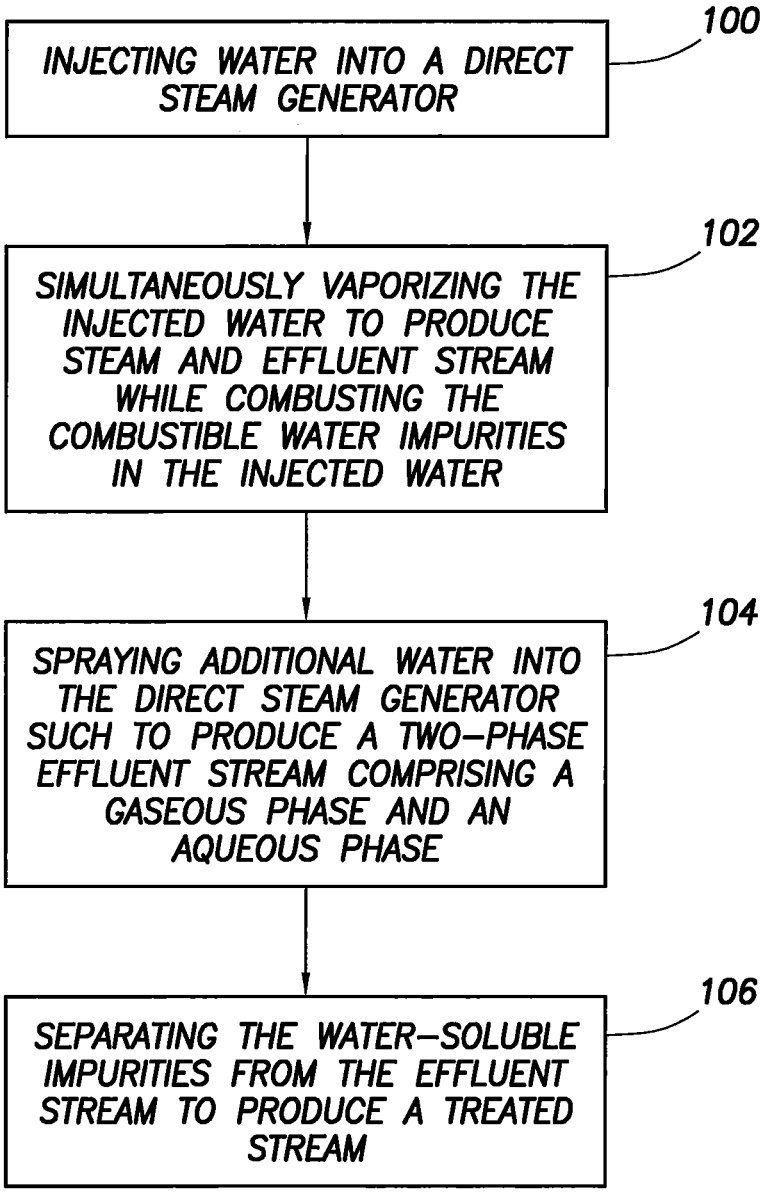
FIG. 2 depicts a flow diagram depicting the steps of the direct steam generator.

FIG. 2 depicts a flow diagram of one embodiment of the method. In this flow diagram the first step is to inject water into a direct steam generator 100. The rate of flow into the direct steam generator would be dependent upon the untreated water needing to be filtered. Within operational range of the direct steam generator the effectiveness would not depend upon the amount of untreated water injected into the direct steam generator.

The second step involves simultaneously vaporizing the injected water with the direct steam generator to produce steam an effluent stream while combusting the combustible water impurities in the injected water inside the direct steam generator 102.

The third step involves spraying additional water into the direct steam generator such that the effluent stream is oversaturated to produce a two-phase effluent stream comprising a gaseous phase and an aqueous phase that contains the water-soluble impurities in the effluent stream 104.

The fourth step involves separating the water-soluble impurities from the effluent stream of the direct steam generator in a phase separation vessel to produce a treated stream 106.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising:

a) injecting water into a direct steam generator;

b) simultaneously vaporizing the injected water with the direct steam generator to produce steam while combusting combustible water impurities in the injected water inside the direct steam generator;

c) spraying additional water into the direct steam generator without prior removal of solid particles such that output is oversaturated to produce a two-phase effluent stream comprising a gaseous phase and an aqueous phase that contains water-soluble impurities in the effluent stream; and d) separating the aqueous phase containing the water-soluble impurities from the effluent stream of the direct steam generator in a phase separation vessel to produce a treated stream.

2. The method of claim 1, wherein the separating the aqueous phase from the two-phase effluent stream is performed by a cyclone or a cyclonic device.

3. The method of claim 1, wherein the treated stream is recycled as spraying water.

4. The method of claim 1, further comprising vaporizing the treated stream that has had solids removed and injecting resulting steam in a steam injection well of a steam assisted gravity drainage system.

5. The method of claim 1, wherein the combustible water impurities comprise oil impurities, natural gas and combinations thereof.

6. The method of claim 1, further comprising injecting the gaseous phase from the direct steam generator in a steam injection well of a steam gravity drainage operation.

7. The method of claim 1, wherein the phase separation vessel is a knock-out pot for removing liquids from a two-phase effluent stream.

8. The method of claim 1, wherein the phase separation vessel is a knock-out pot with a demister pad to remove entrained liquid droplets from a two-phase effluent stream.

9. The method of claim 1, further comprising removing solids from the aqueous phase.

* * * * *